US006260816B1

(12) United States Patent
Valero Salinas

(10) Patent No.: US 6,260,816 B1
(45) Date of Patent: Jul. 17, 2001

(54) DISCARDABLE FORMWORK FOR COLUMNS

(76) Inventor: Jose Manuel Valero Salinas, Ctra. Nac. 340 P.K. 693,9 Autovia A-7 Salida 80, 03350 Cox (ES)

( * ) Notice: Subject to any disclaimer, the term of this patent is extended or adjusted under 35 U.S.C. 154(b) by 0 days.

(21) Appl. No.: 09/402,833

(22) PCT Filed: Feb. 2, 1999

(86) PCT No.: PCT/ES99/00030

§ 371 Date: Oct. 13, 1999

§ 102(e) Date: Oct. 13, 1999

(87) PCT Pub. No.: WO99/43912

PCT Pub. Date: Sep. 2, 1999

(30) Foreign Application Priority Data

Feb. 26, 1998 (ES) ..... 9800419
Nov. 26, 1998 (ES) ..... 9802487

(51) Int. Cl.[7] ..... E04G 13/02
(52) U.S. Cl. ..... 249/48; 249/51
(58) Field of Search ..... 249/17, 48, 49, 249/51; 52/745.17; 264/32

(56) References Cited

U.S. PATENT DOCUMENTS 1,299,739 * 4/1919 Landwehr ..... 249/48
2,873,503 * 2/1959 Davis ..... 249/48
3,350,049 10/1967 Reiland .
4,767,095 8/1988 Fitzgerald et al. .
4,887,789 * 12/1989 Harris et al. ..... 249/48

FOREIGN PATENT DOCUMENTS

679791 * 4/1992 (CH) ..... 249/48
44 17 466 10/1995 (DE) .
0 440 587 8/1991 (EP) .
440587 * 8/1991 (EP) ..... 249/48
0 593 009 4/1994 (EP) .
591571 * 4/1994 (EP) ..... 249/48
1011947 10/1989 (ES) .
2113777 5/1998 (ES) .
2318986 * 2/1977 (FR) ..... 249/48
WO 93/14287 7/1993 (WO) .

* cited by examiner

*Primary Examiner*—Michael Safavi
(74) *Attorney, Agent, or Firm*—Young & Thompson

(57) ABSTRACT

A formwork is structured from a tubular body or core made of a plurality of parts, attached to each other by an adhesive through their connecting edges. The tubular core is internally coated with a sheet made of plastic, or rigid plates made of wood plasticized on the internal side or made of rigid plastic, attached to each other on their inner side with the help of an adhesive constituting an impervious barrier. Externally the formwork has a reticulated support having a fiber glass mesh rolled up helicoidally on the tubular core and fixed to the core by an adhesive in such a way that the mesh ensures the proper mechanical rigidity of the formwork. Optionally, a self-adhesive sealing band can be placed on the enveloping mesh as a decorative element and as a formwork advertising support.

14 Claims, 3 Drawing Sheets

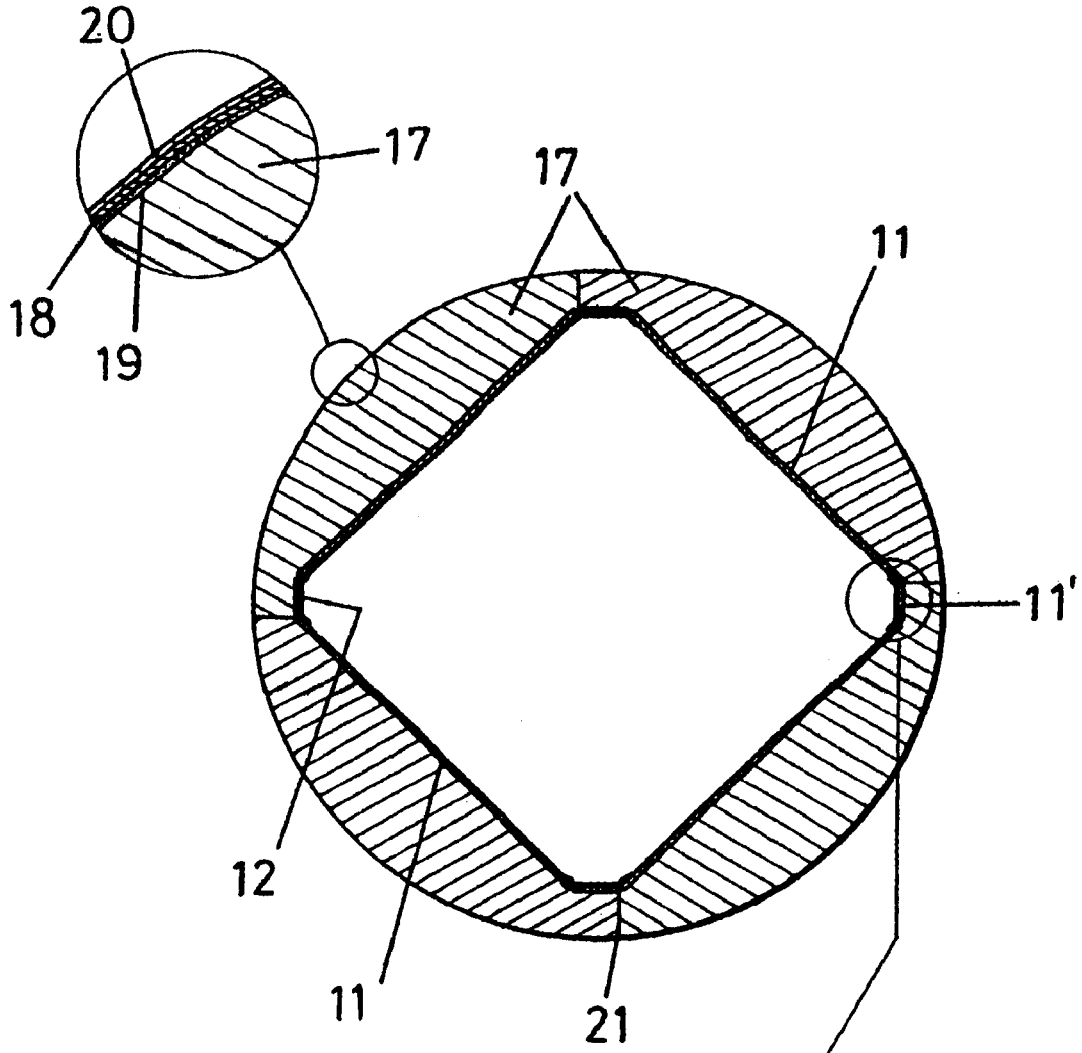
FIG.2
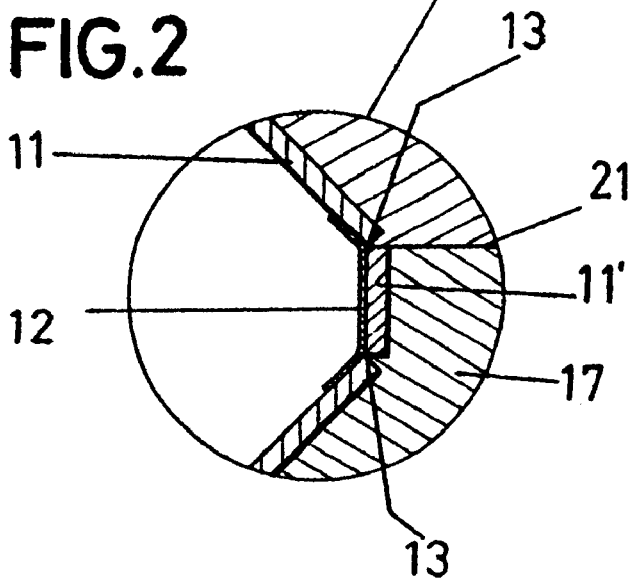

DISCARDABLE FORMWORK FOR COLUMNS

OBJECT OF THE INVENTION

The present invention relates to a new disposable formwork for the obtention of columns, for example made out of reinforced concrete, said formwork having an optimum performance based on a simple and therefore economical structure.

Furthermore, it is possible to obtain with this formwork a perfect superficial finish of the columns, which makes it equally usable for the obtention of columns to be covered and for columns which surface will be seen and therefore require an optimum superficial finish.

BACKGROUND OF THE INVENTION

It is evident that, to build a column made of, for example, reinforced concrete, a mould or formwork is needed to provide the column with its configuration and dimensions, said formwork requiring two different and complementary features: on the one hand it has to ensure a perfect superficial finish of the columns and on the other hand, especially when the formwork is disposable, its cost has to be sufficiently low to make it profitable for the builder.

In the field of disposable formworks for the manufacture of cylindrical columns, formworks are known based on a tubular body, made of paperboard, with its internal side covered by a waterproof liner thus avoiding the deterioration of the paperboard due to the humidity generated from the concrete, said liner being obtained from an aluminium complex. The tubular body has, additionally, another external liner, generally plasticised, to protect likewise the paperboard and to mark the product externally.

For the manufacture of columns with polygonal section, for example columns with a square section, polystyrene plates duly configured to be adapted externally to the cylindrical wall of the tube and to form, as a whole, the desired polygonal section of the column, are established and attached conveniently inside said tubular body.

The above-mentioned solutions, although they are functionally valid, are structurally complex and economically expensive. They present, furthermore, some limitations regarding the possibilities to design certain types of columns due to the fact that the filling plates have to be introduced and to be attached inside the tubular pre-existing body.

DESCRIPTION OF THE INVENTION

The disposable formwork for columns proposed by this invention solves the problems mentioned above in a completely satisfactory way.

To achieve this, in particular, said formwork comprises a tubular body, made of polystyrene or a similar material, based on a plurality of intercoupling pieces or plates defining an internal hollow space, the form and dimensions of which coincide with those of the column to be obtained, and an external preferably cylindrical surface, that could also adopt similarly a polygonal configuration, with the particularity that it has, attached with adhesive to the inner side of said tubular body, a plastic sheet, for example made of PVC or the like, closed over itself by any conventional means, to configure also a tubular body having a sealed surface; on the outer side, the formwork comprises a reticulated support, made of a glass fibre mesh, that rolls up helicoidally on the tubular body defined by the polystyrene parts to which it is attached with adhesive as well.

As a complement of the described structure, the formwork may comprise externally, i.e., outside the mesh, a sealing band, also rolled up helicoidally on the formwork, totally covering the surface of the mesh or, if rolled with a bigger pitch, leaving part of the mesh visible; said sealing band has mainly a decorative function and can serve as product advertising support.

When due to the manufacturing conditions, the correspondent column must present a perfectly smooth surface, the above solution may be inadequate because in the plastic sheet made of PVC or the like, which constitutes the inner operative surface of the formwork, they often appear small wrinkles that are transmitted then to the concrete mass forming the column, causing superficial irregularities; this is why it has been foreseen to substitute said inner plastic sheet of PVC or the like by plates of reduced thickness, with the same amount and dimensions as the sides or plans of the column to be obtained.

Said plates of reduced thickness may be made of plasticised wood, like MDF, or they may consist of rigid plastic plates.

Said plates are attached to each other to configure the required tubular body, with the help of adhesive tapes fixed to what will become their inner side; in the case of wooden plates being used, said adhesive tapes have the complementary purpose of sealing the tubular body, thus preventing the water from the concrete to penetrate through the edges of the wooden plates, said plates edges being obviously not plasticised in order to allow the use of commercial panels.

In case of rigid plastic plates being used, where the adhesive tapes do not have a sealing function, said tapes can be located on the external side of the tubular body for the purpose of avoiding any marks, despite their reduced thickness, on the surface of the column.

According to another feature of the invention it is provided, for the manufacture of polygonal columns with bevelled edges, instead of the plasticised wooden strips or the plastic strips corresponding to said bevelled edges, plastics profiles are used which determine the plan that corresponds to said faces and, additionally, said profiles comprise lateral grooves properly oriented and dimensioned to allow the engagement of the plates, made of wood or plastic and corresponding to the main lateral walls of the column; said grooves present their open side sufficiently throttled as to allow the engagement of said plates under pressure and in a completely watertight manner concerning the edges of said plates.

According to the above, not only a perfect superficial finish of the column to be obtained is achieved but furthermore the whole set can be easily disassembled and reused because the inner liner is not glued to the polystyrene, which has an ecological impact.

However it may be desirable that the surface of the column to be obtained, instead of being completely smooth, presents some relief simulating streaks and knots of the wood, as when a conventional formwork based on conveniently intercoupled wooden panels is used to define a cylindrical receptacle; in this case, and according to another feature of the invention, it is provided the use of strips of noble wood, waxed on their inner side to facilitate the removal of the formwork, attached with glue to the tubular body of polystyrene, before the definitive attachment of the parts constituting the same, preferably when the body is build in two halves that will finally be closed one on each other after said noble wooden strips have been fixed to them by means of an adhesive.

In any case, and in the same way as foreseen in the main patent, the tubular polystyrene body, properly closed and wearing on its interior side the liner made of plasticised wooden plates, plastic plates or noble wooden strips, is externally surrounded by the grid made of fibre glass mesh, forming a continues band rolled up helicoidally, and being optionally assisted by said sealing band.

Finally and according to another feature of the invention, in case of columns with polygonal cross-section, for example square or rectangular section, it is foreseen the location of seals acting as a signalling system at the ends of the formwork, in a position that corresponds to the edges of the column, to facilitate the mounting of said formwork during the building works in the correct position.

DESCRIPTION OF THE DRAWINGS

To complete the present description and to contribute to a better understanding of the features of the present invention, according to a preferred embodiment of the same, a set of figures is attached as part of said description; said set of drawings is included for illustrative and not limitative purposes, and they show the figures in which:

FIG. 2 shows, according to a similar representation of the preceding figure, an alternative embodiment of the disposable formwork for columns in which the inner sealed liner has been modified.

PREFERRED EMBODIMENT OF THE INVENTION

Figure 1:
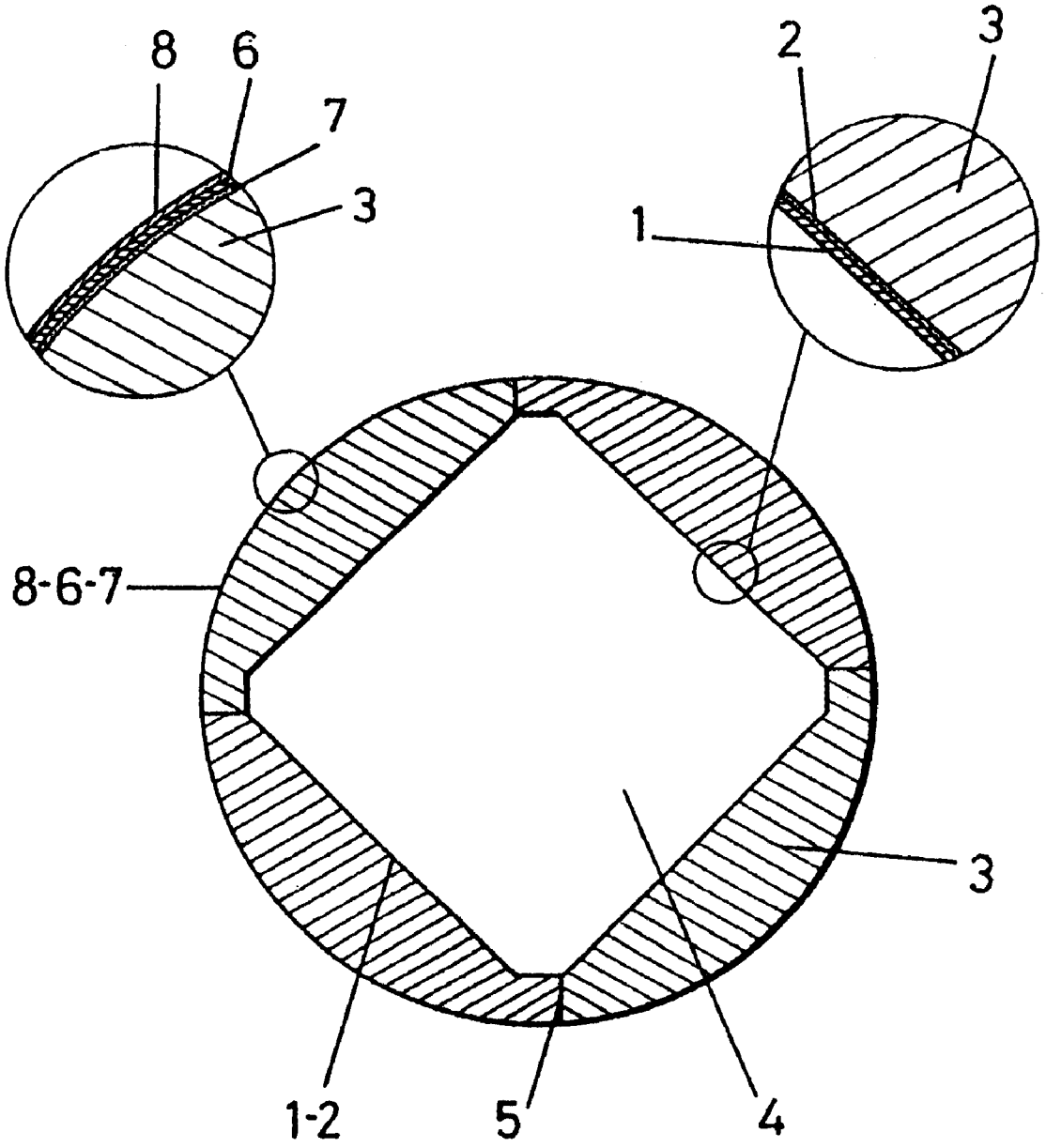
FIG. 1 shows, according to a schematic cross-section representation, a disposable formwork for columns made according to the object of the present invention, in the particular case where it is intended to obtain a column with square section and with bevelled edges.

Referring to the figures, and particularly to FIG. 1, it can be seen that the disposable formwork for columns according to the invention is made of a plastic sheet (1), of PVC or other appropriate material being able to establish an impervious barrier in the context of the formwork, particularly with reference to its inner side; fixed with a layer of glue (2) to said plastic sheet is a series of polystyrene parts (3) which configure, as a whole, a tubular body, the internal form (4) and the dimensions of which correspond to those of the column to be obtained; the body is provided by the inner sealed liner defined by said sheet (1), said parts (3) being attached to each other through their mutual contact edges (5), which can adopt the radial configuration shown in said FIG. 1, a graded configuration, or any other configuration, this not being essential for the present invention; in any case the tubular body defined by the parts (1) presents an outer surface, preferably cylindrical, as indicated in said figure, because this is advantageous to achieve an appropriate attachment of said parts, with a maximum mechanical resistance, generated by the outer enveloping (6) surrounding the same; however said outer surface could also adopt a polygonal configuration or any other that might be convenient, for example an elliptical configuration when columns having a rectangular section must be obtained.

In any case said enveloping (6) is made of a fibre glass mesh attached to the tubular body defined by the polystyrene parts (3) by means of a layer of adhesive (7).

Finally the whole set described above is completed with an external sealing band (8), preferably a self-adhesive band, giving a final aesthetic touch to the whole, said band constituting the advertising support for the product and covering totally or partially the mesh (6), or being a part of said mesh, in such a way that the mesh (6) and the seal (8) form a whole before being applied to the tubular body (3).

As already mentioned before, this formwork has an optimal performance when a perfect superficial finish of the column is not required; however it can be improved when said type of superficial finish is required.

Figure 3:
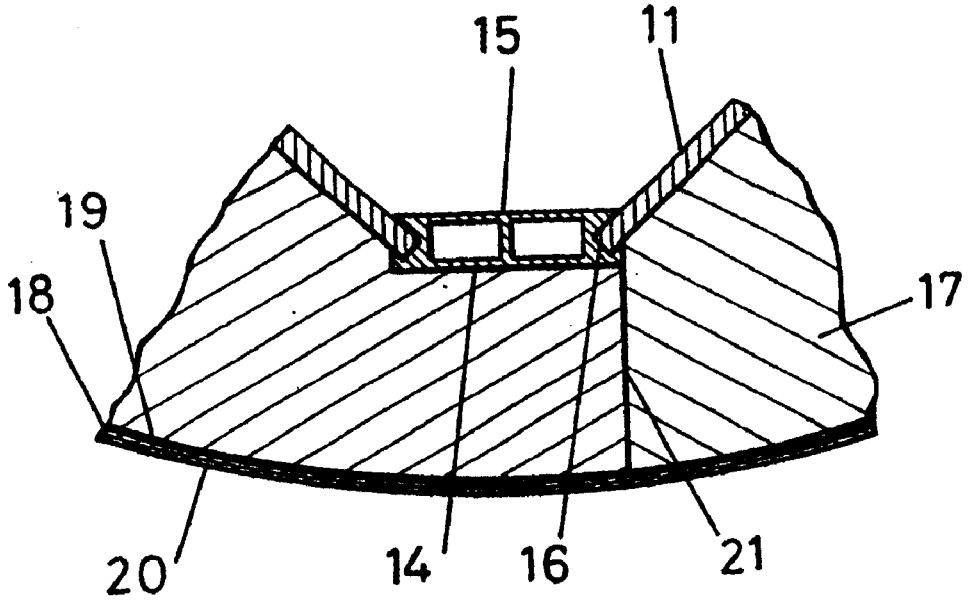
FIG. 3 shows an amplified detail of the section of the preceding figure, at the level of one of the bevelled edges, according to an embodiment in which profiles are used for the bevelled edges of the column.
Figure 4:
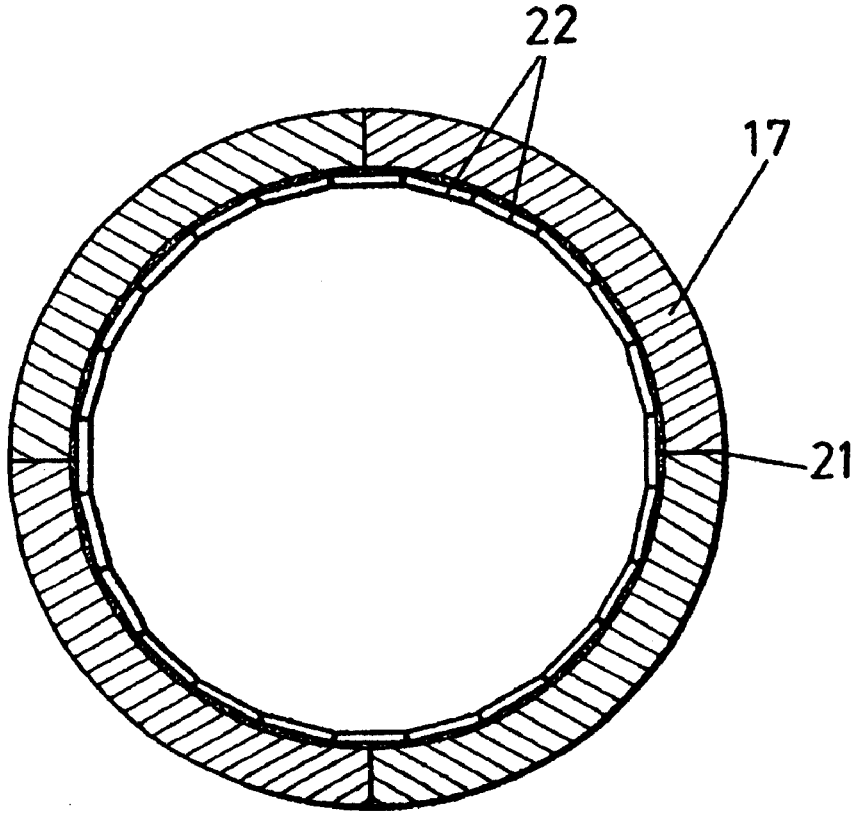
FIG. 4 shows a schematic cross-section similar to FIG. 2, but corresponding to a disposable formwork provided for the obtention of a multiple-face column, tending to a cylindrical shape, having an irregular surface imitating the wood.

For this purpose, as shown in FIGS. 2 and 3, instead of a plastic and watertight sheet (1) being used as inner liner or internal layer of the formwork in FIG. 1, it is foreseen the use of a plurality of plates (11) of reduced thickness, made of plasticised wood or rigid plastic, the form and the dimensions of which correspond to those of the lateral sides of the column to be obtained, and correspond also to the bevelled edges when applicable; in case of columns with bevelled edges, strips (11') will be used, said strips being obviously narrower and presenting obviously the plasticised side at their inner face, the one that will contact the concrete, in order to protect properly the wood against the humidity coming from the concrete; said plates and strips (11–11') being attached with the help of adhesive tapes (12) fixed to their inner side and overlapping the intercoupling edges (13) with the double function of, in one hand, fixing said plates and strips (11–11') to constitute a tubular body, and in the other, in the specific case of using plasticised wooden plates, protecting their edges, which are obviously not plasticised, from the humidity.

However, in the case of columns with bevelled edges as shown in FIG. 2, there is the possibility to replace the wooden or plastic strips (11') by profiles (14) extruded in plastic, which define an internal flat face (15), having a form and the dimensions that correspond to those of the bevelled edges to be obtained, and furthermore incorporating lateral grooves (16) for a perfect fit of the coupling the plates (11) in such a way that they not only result with a perfect attachment to each other by means of the profiles (14) but additionally their edges become perfectly protected against humidity, in the case with wooden plates, because they are appropriately fit inside said grooves (16).

In any case, similarly to what has been described in FIG. 1, this inner liner of the formwork is adapted to a tubular body based on a plurality of polystyrene parts (17) properly intercoupled and attached by means of adhesive, defining an inner space that coincides with the liner defined by the plates (11–11') and an outer cylindrical configuration over which an external enveloping (18) is established, which is made of a fibre glass mesh fixed to the tubular body defined by the polystyrene parts (17) by means of an adhesive layer (19), and which is optionally complemented with an external sealing band (20), preferably a self-adhesive band, which gives a final aesthetic touch to the whole, which constitutes the advertising support for the product and which can cover totally or partially said mesh (18), or even can form a part of the latter, in such a way that the mesh (18) and the seal (20) form a whole before they are applied to the tubular body.

From the above it can be deduced that the totally smooth surface of the plates (11–11') has an influence in the manufacture of an also totally smooth surface of the column to be obtained, which surface is only influenced by the tiny thickness of the adhesive tape (12), practically negligible, and which has no influence at all when the profiles of FIG. 3 are used.

Finally, as a complementary feature of the described structure, it is provided the location on each end of the formwork, in correspondence to the zones (21) facing the edges of the column to be obtained, of small seals, not shown in the figures, acting as a signalling system to facilitate the correct positioning of the formwork on the cementing ground in order to achieve a correct positioning of the column to be obtained.

However, as already mentioned above, it may be desirable that the column to be obtained does not present a totally smooth surface bit a surface with the appearance of wood, showing the streaks and knots of said wood; in this case, instead of using the plates (11—11') mentioned above, noble wooden strips or laths (22) are used, without any superficial treatment other than sandpapering or waxing in order to facilitate the later removal of the formwork, said wooden strips (22) being attached to the tubular body defined by the polystyrene parts (17) by means of adhesive, and properly intercoupled through their edges, as shown especially in FIG. 2.

For this purpose it is foreseen the use of a mould with a preferred gorge configuration (in case of cylindrical columns), having a curved convex operative surface, on which the wooden strips (22) are successively disposed, properly intercoupled, to apply thereafter the adhesive on the external face of all of them and to finally fix on them the correspondent polystyrene parts (17).

By means of this embodiment, instead of obtaining columns presenting a perfectly smooth surface, like in the case shown in FIG. 2, columns are obtained with a rough surface reproducing the streaks and knots of the wood, giving the impression that the column has been obtained by artisan form working methods.

What is claimed is:

1. A disposal formwork for columns comprising:

a tubular body formed by a plurality of parts having edges connected by an adhesive, said parts defining a hollow tubular space and an external surface;

said hollow tubular space having a form and dimensions corresponding to the column to be obtained and having a watertight liner; and said external surface being covered by a reticulated support, said reticulated support being fixed to the tubular body by an adhesive.

2. The disposable formwork for columns according to claim 1, wherein a sealing means seals said edges and wherein said watertight liner is a plastic sheet fixed to the tubular body by an adhesive.

3. The disposable formwork for columns according to claim 1, wherein the reticulated support is a glass fiber mesh totally covering the surface of said tubular body.

4. The disposable formwork for columns according to claim 1, wherein a sealing band covers said reticulated support totally and acts as a decorative element and as an advertising support for the formwork.

5. The disposable formwork for columns according to claim 1, wherein a sealing band covers said reticulated support partially and acts as a decorative element and as an advertising support for the formwork.

6. The disposable formwork for columns according to claim 4, wherein the sealing band is integral with the reticulated support.

7. The disposable formwork for columns according to claim 1, wherein the cross-section of said parts constituting the tubular body varies depending on the section of the column to be obtained and said parts have a varying internal surface depending on the desired superficial configuration of the column to be obtained.

8. The disposable formwork for columns according to claim 1, wherein the inner watertight liner is made of a plurality of rigid plates attached to each other but independent of the inner surface defining a smooth and sealed surface which is transmitted to the surface of the column to be obtained.

9. The disposable formwork for columns according to claim 8, wherein said plates are made of plasticized wood on their internal face.

10. The disposable formwork for columns according to claim 8, wherein said plates are made of plastic.

11. The disposable formwork for columns according to claim 8, wherein said rigid plates have junction edges and are attached to each other by an adhesive at said junction edges.

12. The disposable formwork for columns according to claim 11, further comprising profiles having flat surfaces and lateral grooves dimensioned and oriented in order to receive said junction edges of said rigid plates.

13. The disposable formwork for columns according to claim 8, wherein said columns have an irregular surface, simulating the relief of streaks and knots of a conventional artisan formwork, said inner surface of the formwork being wooden and made of laths of noble wood, sandpapered and waxed to facilitate the removal of the formwork.

14. The disposable formwork for columns according to claim 11, wherein said rigid plates are wooden plates that seal said junction edges to protect said edges from humidity.

* * * * *